US010765247B2

(12) United States Patent
Moss et al.

(10) Patent No.: US 10,765,247 B2
(45) Date of Patent: Sep. 8, 2020

(54) SUPPORT BRACKET FOR ROD ASSEMBLY

(71) Applicant: House of Atlas, LLC, Evanston, IL (US)

(72) Inventors: Jason Moss, Libertyville, IL (US); Alan Arthur Ford, Sturgis, MI (US); Matthew Berman, Chicago, IL (US)

(73) Assignee: House of Atlas, LLC, Evanston, IL (US)

( * ) Notice: Subject to any disclaimer, the term of this patent is extended or adjusted under 35 U.S.C. 154(b) by 0 days.

(21) Appl. No.: 15/922,653

(22) Filed: Mar. 15, 2018

(65) Prior Publication Data

US 2018/0199747 A1 Jul. 19, 2018

Related U.S. Application Data

(63) Continuation-in-part of application No. 14/855,796, filed on Sep. 16, 2015, now abandoned.

(51) Int. Cl.

| | |
|---|---|
| ***A47H 1/14*** | (2006.01) |
| ***A47H 1/142*** | (2006.01) |
| ***A47H 1/102*** | (2006.01) |
| *A47H 1/02* | (2006.01) |
| *A47H 1/00* | (2006.01) |

(52) U.S. Cl.

CPC ..... *A47H 1/142* (2013.01); *A47H 1/102* (2013.01); *A47H 2001/006* (2013.01); *A47H 2001/021* (2013.01)

(58) Field of Classification Search

CPC ..... A47H 1/142; A47H 1/04; A47H 1/102
See application file for complete search history.

(56) References Cited

U.S. PATENT DOCUMENTS

| | | | |
|---|---|---|---|
| 241,991 | A | 5/1881 | Jones |
| 331,850 | A | 12/1885 | Umstadter |
| 726,950 | A | 5/1903 | Larson |
| 732,821 | A | 7/1903 | Bitner |
| 762,594 | A | 6/1904 | Michaels |
| 940,711 | A | 11/1909 | Eells |
| 969,051 | A | 8/1910 | Garraway |
| 999,675 | A | 8/1911 | Schmitz |
| 1,004,471 | A | 9/1911 | Rose |
| 1,024,349 | A | 4/1912 | Mattern |
| 1,033,440 | A | 7/1912 | Moffat |
| 1,052,447 | A | 2/1913 | Armstrong |
| 1,104,545 | A | 7/1914 | Reitz |
| 1,115,997 | A | 11/1914 | Withrow |
| 1,120,935 | A | 12/1914 | Hammers |

(Continued)

OTHER PUBLICATIONS

Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.

(Continued)

*Primary Examiner* — Amy J. Sterling
(74) *Attorney, Agent, or Firm* — Fitch Even Tabin & Flannery LLP

(57) ABSTRACT

There is provided a bracket and rod assembly system having improved strength and configured to allow complete access of a drapery supported by the rod assembly to an entire length of the rod assembly without interference from the bracket.

12 Claims, 15 Drawing Sheets

(56) References Cited

U.S. PATENT DOCUMENTS

| | | | | |
|---|---|---|---|---|
| D47,004 | S | 2/1915 | Martin | |
| 1,187,366 | A | 6/1916 | Mozroll | |
| 1,333,163 | A | 3/1920 | Eddy | |
| D55,157 | S | 5/1920 | Dubish | |
| 1,341,535 | A | 5/1920 | Becker | |
| 1,384,246 | A | 7/1921 | Durnell | |
| 1,445,372 | A | 2/1923 | Wallace | |
| 1,451,764 | A | 4/1923 | Dick | |
| 1,461,855 | A | 7/1923 | Kroesser | |
| 1,492,210 | A | 4/1924 | Kelly | |
| 1,498,849 | A | 6/1924 | London | |
| 1,525,895 | A | 2/1925 | Sherwood | |
| 1,530,167 | A | 3/1925 | Friend | |
| 1,593,114 | A | 7/1926 | Wyatt | |
| 1,596,506 | A | 8/1926 | Morgan | |
| 1,658,815 | A | 2/1928 | Oskamp | |
| D76,109 | S | 8/1928 | Vermillion | |
| 1,805,784 | A | 5/1931 | Peterson | |
| D101,104 | S | 7/1936 | Bushey | |
| 2,135,159 | A | 11/1938 | Zbock | |
| 2,151,223 | A | 3/1939 | Nayman, Sr. | |
| 2,234,099 | A | 3/1941 | Westfall | |
| 2,240,225 | A | 4/1941 | Place | |
| 2,288,303 | A | 6/1942 | Ryan | |
| 2,293,168 | A | 8/1942 | Pirone | |
| 2,374,787 | A * | 5/1945 | Spiegel | A47K 10/04 211/105.1 |
| 2,386,854 | A | 10/1945 | William | |
| 2,474,434 | A | 6/1949 | Mentz | |
| 2,644,191 | A | 7/1953 | Meyer | |
| 2,720,373 | A | 10/1955 | Bell | |
| 2,725,989 | A | 12/1955 | Burkey | |
| 2,783,014 | A | 2/1957 | Kenney | |
| 2,789,783 | A | 4/1957 | Jones | |
| 2,848,184 | A | 8/1958 | Kennedy | |
| 2,859,879 | A | 11/1958 | Rogers | |
| 2,964,280 | A | 12/1960 | Rinaldi | |
| 3,049,327 | A | 8/1962 | Caudell | |
| 3,104,086 | A | 9/1963 | Salzmann | |
| 3,219,302 | A | 11/1965 | Smith | |
| 3,289,992 | A | 12/1966 | Brooks | |
| 3,312,442 | A | 4/1967 | Moeller | |
| 3,430,908 | A | 3/1969 | Kowalczyk | |
| 3,724,085 | A | 4/1973 | Wentworth | |
| 3,778,955 | A | 12/1973 | Close | |
| D242,986 | S | 1/1977 | Inglis | |
| 4,039,136 | A | 8/1977 | Dehart | |
| 4,060,905 | A | 12/1977 | Light | |
| D251,180 | S | 2/1979 | Mader | |
| 4,140,294 | A | 2/1979 | Zwarts | |
| D253,162 | S | 10/1979 | Sheehan | |
| 4,226,395 | A | 10/1980 | Bellinger | |
| 4,316,546 | A | 2/1982 | Varon | |
| 4,322,050 | A | 3/1982 | Roach | |
| 4,455,007 | A | 6/1984 | Varon | |
| 4,473,957 | A | 10/1984 | Faulkner | |
| 4,509,713 | A | 4/1985 | Hogg | |
| D290,931 | S | 7/1987 | Powell | |
| 4,684,095 | A | 8/1987 | Athey | |
| 4,708,311 | A | 11/1987 | Clausen | |
| 4,878,528 | A | 11/1989 | Kobayashi | |
| 5,028,030 | A | 7/1991 | Lewis | |
| 5,054,728 | A | 10/1991 | Nigro, Jr. | |
| 5,103,574 | A | 4/1992 | Levy | |
| 5,193,775 | A | 3/1993 | Wagnon | |
| 5,195,570 | A | 3/1993 | Marocco | |
| 5,398,900 | A | 3/1995 | Schober | |
| 5,577,700 | A | 11/1996 | Williams | |
| D376,755 | S | 12/1996 | Cox | |
| 5,678,703 | A * | 10/1997 | Sawyer | A47H 1/02 211/105.1 |
| D389,035 | S | 1/1998 | Smiley | |
| 5,802,729 | A | 9/1998 | O'Brien | |
| D408,722 | S | 4/1999 | Sartini | |
| D411,951 | S | 7/1999 | Bibby | |
| 5,927,675 | A | 7/1999 | Kratish | |
| D420,567 | S | 2/2000 | Laga | |
| 6,233,877 | B1 | 5/2001 | Monroe | |
| 6,325,349 | B1 | 12/2001 | Breaux | |
| 6,357,716 | B1 | 3/2002 | Kratish | |
| D455,334 | S | 4/2002 | Ivankovic | |
| 6,367,755 | B1 | 4/2002 | Arena | |
| 6,371,423 | B1 * | 4/2002 | Miller | A47H 1/102 211/123 |
| 6,371,427 | B1 | 4/2002 | Johnson | |
| 6,409,140 | B1 | 6/2002 | Kratish | |
| 6,450,233 | B1 | 9/2002 | Becker | |
| D464,013 | S | 10/2002 | Adams | |
| 6,471,175 | B1 | 10/2002 | Kratish | |
| 6,481,584 | B1 | 11/2002 | Cantley | |
| 6,554,237 | B1 | 4/2003 | Weber | |
| D478,804 | S | 8/2003 | Titus | |
| 6,640,512 | B1 | 11/2003 | Kinnaman | |
| 6,695,276 | B2 | 2/2004 | Skorka | |
| 6,739,065 | B2 | 5/2004 | Hofmeister | |
| 7,210,243 | B2 | 5/2007 | Schmidt | |
| 7,448,507 | B1 | 11/2008 | Abernathy, Jr. | |
| D602,344 | S | 10/2009 | Olien | |
| D611,328 | S | 3/2010 | Hanley | |
| 7,802,769 | B1 | 9/2010 | Lindsey | |
| 7,861,989 | B2 | 1/2011 | Cross | |
| D638,282 | S | 5/2011 | Robinson | |
| 8,011,635 | B2 | 9/2011 | Aleo | |
| D646,957 | S | 10/2011 | Syed | |
| 8,056,873 | B1 | 11/2011 | Hanely | |
| 8,069,507 | B2 | 12/2011 | Didehvar | |
| D658,043 | S | 4/2012 | Burr | |
| 8,185,981 | B2 | 5/2012 | Didehvar | |
| 8,231,093 | B2 * | 7/2012 | Tran | A47H 1/142 16/87.2 |
| 8,297,576 | B2 | 10/2012 | McLeod | |
| 8,341,775 | B2 | 1/2013 | Didehvar | |
| 8,356,782 | B2 | 1/2013 | Robichaud | |
| D678,754 | S | 3/2013 | Burr | |
| 8,418,975 | B1 | 4/2013 | Burr | |
| 8,640,890 | B2 | 2/2014 | Schiller | |
| D707,535 | S | 6/2014 | Burr | |
| 8,814,114 | B2 | 8/2014 | Baines | |
| 8,844,886 | B2 | 9/2014 | Mejia | |
| 8,851,435 | B1 | 10/2014 | Bastien | |
| 8,979,911 | B2 | 3/2015 | Martineau | |
| 9,021,627 | B2 | 5/2015 | Parker | |
| 9,216,045 | B2 | 12/2015 | Martineau | |
| 9,486,913 | B2 | 11/2016 | Thieman | |
| 9,532,663 | B2 | 1/2017 | Nilsson | |
| D805,880 | S | 12/2017 | Bright | |
| D811,205 | S | 2/2018 | Hanley | |
| D813,021 | S | 3/2018 | Hanley | |
| D813,022 | S | 3/2018 | Hanley | |
| 10,047,903 | B2 | 8/2018 | Bruno | |
| 10,064,512 | B2 | 9/2018 | McMillion | |
| 10,070,748 | B2 | 9/2018 | Hanley | |
| 10,092,126 | B2 | 10/2018 | Baines | |
| 10,094,167 | B2 | 10/2018 | Odish | |
| D834,925 | S | 12/2018 | Hanley | |
| D834,926 | S | 12/2018 | Hanley | |
| D834,927 | S | 12/2018 | Hanley | |
| D847,613 | S | 5/2019 | Hanley | |
| 10,278,529 | B2 | 5/2019 | Baines | |
| 10,285,527 | B2 | 5/2019 | Mullet | |
| D856,785 | S | 8/2019 | Hanley | |
| 10,376,086 | B1 | 8/2019 | Mustafa | |
| D858,259 | S | 9/2019 | Hanley | |
| D858,260 | S | 9/2019 | Hanley | |
| D859,963 | S | 9/2019 | Hanley | |
| 10,441,098 | B2 | 10/2019 | Bruno | |
| 10,448,773 | B2 | 10/2019 | Muniz | |
| 2002/0066842 | A1 | 6/2002 | Curry | |
| 2003/0071181 | A1 | 4/2003 | Valiulis | |
| 2004/0159766 | A1 | 8/2004 | Skorka | |
| 2004/0195477 | A1 | 10/2004 | Rivellino | |
| 2005/0218284 | A1 | 10/2005 | Kurrasch | |
| 2008/0156952 | A1 | 7/2008 | Nathan | |
| 2008/0237434 | A1 | 10/2008 | Lin | |

(56) References Cited

U.S. PATENT DOCUMENTS

| | | | |
|---|---|---|---|
| 2009/0101609 | A1 | 4/2009 | Batshon |
| 2009/0193938 | A1 | 8/2009 | Mentor |
| 2010/0224749 | A1 | 9/2010 | Tran |
| 2012/0001039 | A1 | 1/2012 | McDuff |
| 2012/0217362 | A1 | 8/2012 | Affonso |
| 2013/0043357 | A1 | 2/2013 | McLeod |
| 2013/0082017 | A1 | 4/2013 | Tang |
| 2013/0099080 | A1 | 4/2013 | Baines |
| 2013/0341474 | A1 | 12/2013 | Baines |
| 2015/0108304 | A1 | 4/2015 | Larsen Roldan |
| 2015/0265086 | A1 | 9/2015 | Hanley |
| 2015/0272353 | A1 | 10/2015 | Christodoulou |
| 2016/0113447 | A1 | 4/2016 | Walker |
| 2016/0215922 | A1 | 7/2016 | McDuff |
| 2017/0071390 | A1 | 3/2017 | Moss |
| 2018/0064279 | A1 | 3/2018 | Hanley |
| 2018/0199747 | A1 | 7/2018 | Moss |
| 2018/0306219 | A1 | 10/2018 | Hanley |
| 2019/0063671 | A1 | 2/2019 | McDuff |
| 2019/0099034 | A1 | 4/2019 | Hanley |
| 2019/0282017 | A1 | 9/2019 | Hanley |

OTHER PUBLICATIONS

U.S. Appl. No. 16/749,770, dated Jan. 22, 2020.
U.S. Appl. No. 16/791,891, dated Feb. 14, 2020.
U.S. Appl. No. 16/800,594, dated Feb. 25, 2020.

* cited by examiner

SUPPORT BRACKET FOR ROD ASSEMBLY

CROSS-REFERENCE TO RELATED APPLICATION

This application is a continuation-in-part of U.S. application Ser. No. 14/855,796, filed Sep. 16, 2015, which is hereby incorporated by reference herein in its entirety.

FIELD

The present invention relates generally to a support bracket for a rod assembly and, more particularly, to a support bracket for a rod assembly that exhibits improved strength and is configured to allow complete access of a drapery supported by the rod assembly to an entire length of the rod assembly without interference from the bracket.

BACKGROUND

Brackets have long been used for mounting drapery rods, shower curtain rods, and other rods to surfaces such as walls, windows, window frames, window casings, and ceilings. These brackets are offered in many different shapes and sizes and range from highly ornamental designs to simpler utilitarian designs. Often, these brackets have an "L-shaped" configuration, where an arm portion extends horizontally over the top of a vertically-extending mounting portion, and comprise a hook-like feature in which the rod rests, or a ring through which the rod passes. In some commercial embodiments, the rod is allowed to freely rotate and slide back and forth on the bracket. In other commercial embodiments, the rod is secured by the user screwing a set screw through the bracket until it contacts the outer surface of the rod. Often, in such configurations the set screws loosen over time due to repeated movement of the drapery horizontally during regular use and vertically when the drapery is pulled on from below.

In any event, the rod-attachment portion of such brackets are typically visible from the front and contribute to an interrupted appearance of the rod's profile. Such brackets also restrict movement of the drapery along the entire length of the rod, thereby preventing complete drapery coverage along the entire length of the rod. In some instances, rings are used to suspend the drapery from the rod. Complete coverage may be obtained by placing some of the rings outside of the bracket. However, in this configuration the bracket would still be visible from the front and movement of the curtain from side to side is still restricted by the position of the bracket.

Another drawback of conventional brackets is their lack of strength due their "L-shaped" configuration. Conventional "L-shaped" brackets utilize horizontal interfaces or bends where the horizontally-extending arm of the bracket meets the vertically-extending mounting portion. These horizontal interfaces are prone to bending when suspending a heavy rod and/or drapery from the rod attachment portion or when the drapery is pulled downward during use, such as, for example, when opening and closing, cleaning, or children playing behind the drapery.

Therefore, there is a need for a bracket and a rod assembly system that permits complete coverage of the drapery along the entire length of the rod and maximizes drawback without any restriction of movement of the drapery due to the bracket position. There is also a need to provide a bracket that locks the rod in place such that the rod is not permitted to move laterally. Further, there is a need to address load support problems inherent to brackets when heavy drapery is used or when repeated downward force is applied to the rod.

DETAILED DESCRIPTION

Figure 1:
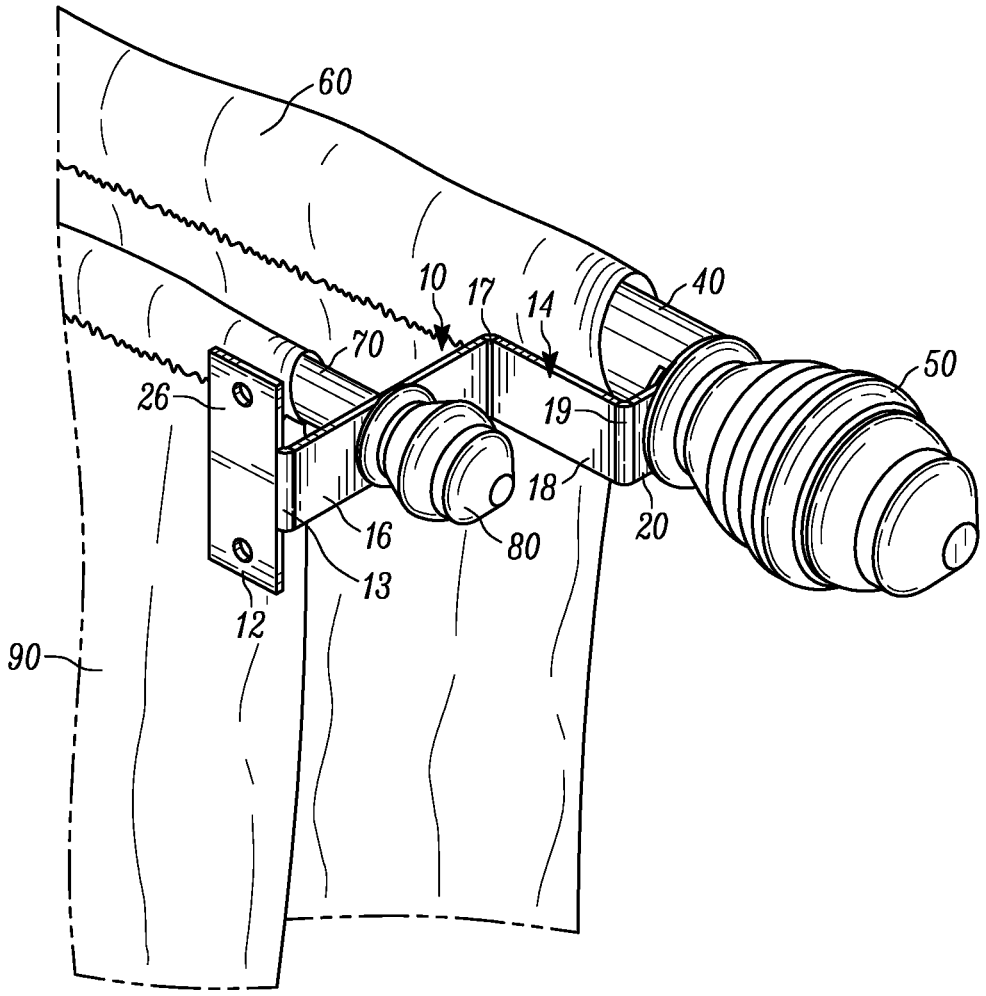
FIG. 1 is a perspective view of a double rod assembly.
Figure 2:
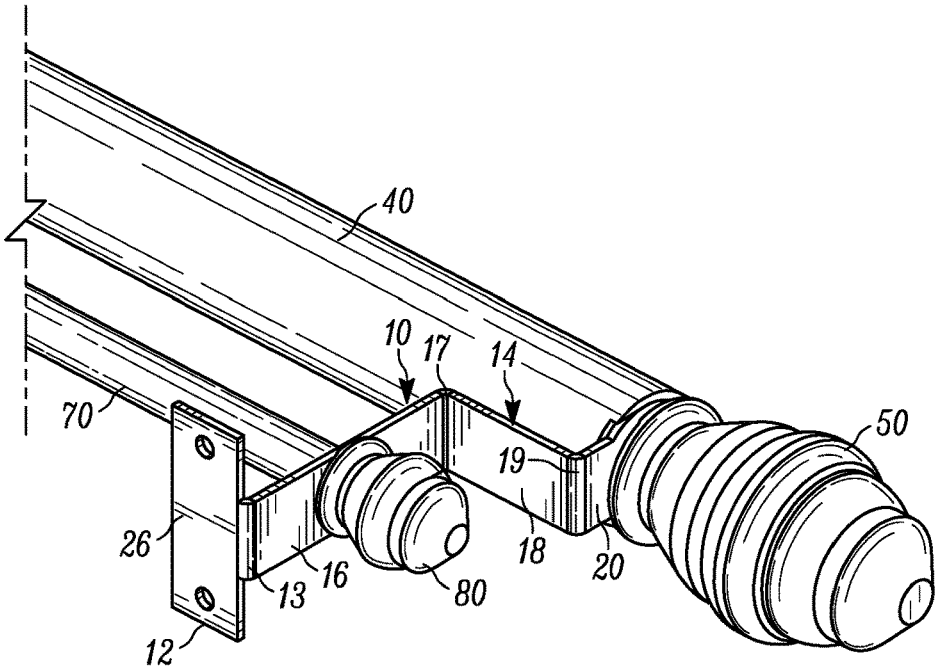
FIG. 2 is a perspective view of a double rod assembly showing a slightly exploded view of the rod, first rod-attachment portion, and finial.
Figure 3:
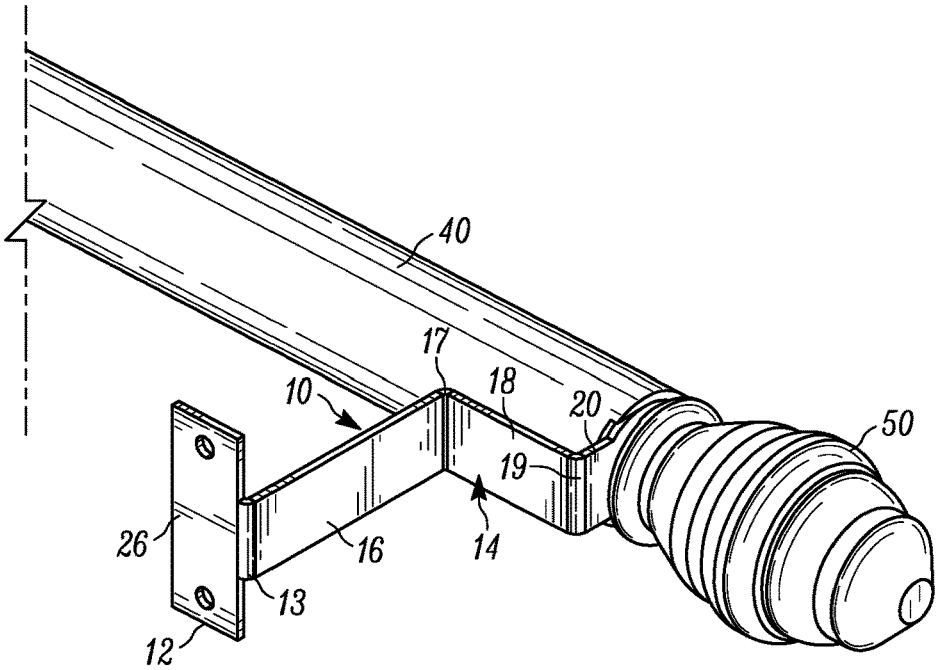
FIG. 3 is a perspective view of a single rod assembly showing a slightly exploded view of the rod, first rod-attachment portion, and finial.

With reference to FIGS. 1-3, there is illustrated a system for supporting a rod 40 from which a swatch material such as, for example, a drapery or curtain 60 may be suspended. The system includes a bracket 10, a rod 40, and a finial 50, which may be formed of any suitable material such as, for example, steel, zinc, aluminum, wood, various forms of plastic, and mixtures thereof. The bracket 10 may be mounted on a surface such as, for example, a wall surface or a window frame. The finial 50 may attach to the end portion of rod 40 such that the bracket 10 is between the end of the rod 40 and the finial 50. The finial 50 may be attached to the rod 40 by any conventional means such as, for example, a threaded screw. The rod assembly system may be configured to support a single rod 40, as illustrated in FIG. 3, or a second rod 70 may be attached to the bracket 10, as illustrated in FIG. 2, which may be used to support a second swatch material such as, for example a sheer 90, as illustrated in FIG. 1.

With reference to FIGS. 4-7, the bracket 10 may include a mounting portion 12, an arm portion 14, and a first rod-attachment portion 20. The mounting portion 12, arm portion 14, and first rod-attachment portion 20 of bracket 10 may comprise a single material or may comprise different materials, and may be integrally formed or may comprise separately-formed components. The mounting portion 12 may comprise any shape and may include a back surface 26 that is substantially flat, and is configured to allow the bracket 10 to be mounted on a surface such as, for example, a wall. The mounting portion 12 may be mounted to the wall using any conventional means such as, for example, threaded screws and drywall anchors.

Figure 8:
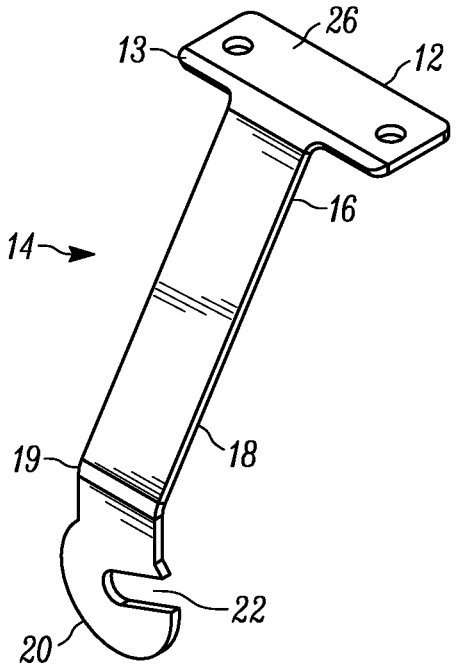
FIG. 8 is a perspective view of an alternate embodiment of a bracket.
Figure 9:
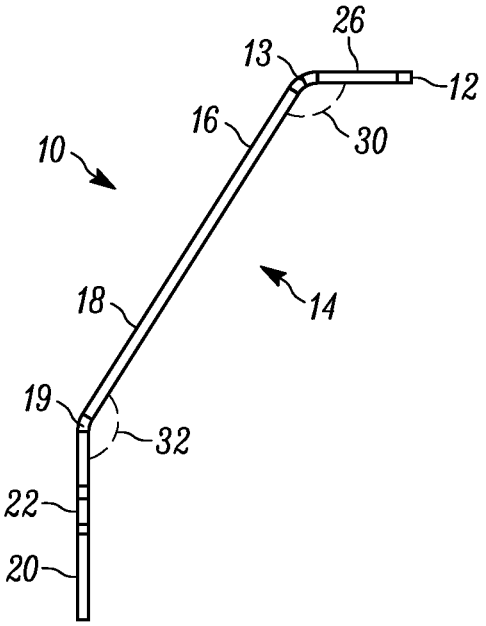
FIG. 9 is a top plan view of the bracket in FIG. 8.

The arm portion 14 may extend outwardly from the mounting portion 12 and may include a proximal segment 16 and a distal segment 18. The arm portion 14 may be shaped such that the distal segment 18 may be substantially parallel to the back surface 26 of the mounting portion 12, and the proximal segment 16 may be substantially parallel to a first rod-attachment portion 20 disposed at the distal segment 18 of the arm portion 14. Alternatively, the arm portion 14 may have a linear configuration, as shown in FIGS. 8 and 9. The arm portion 14 may also have a curved shape, as illustrated in FIGS. 16-22.

Figure 10:
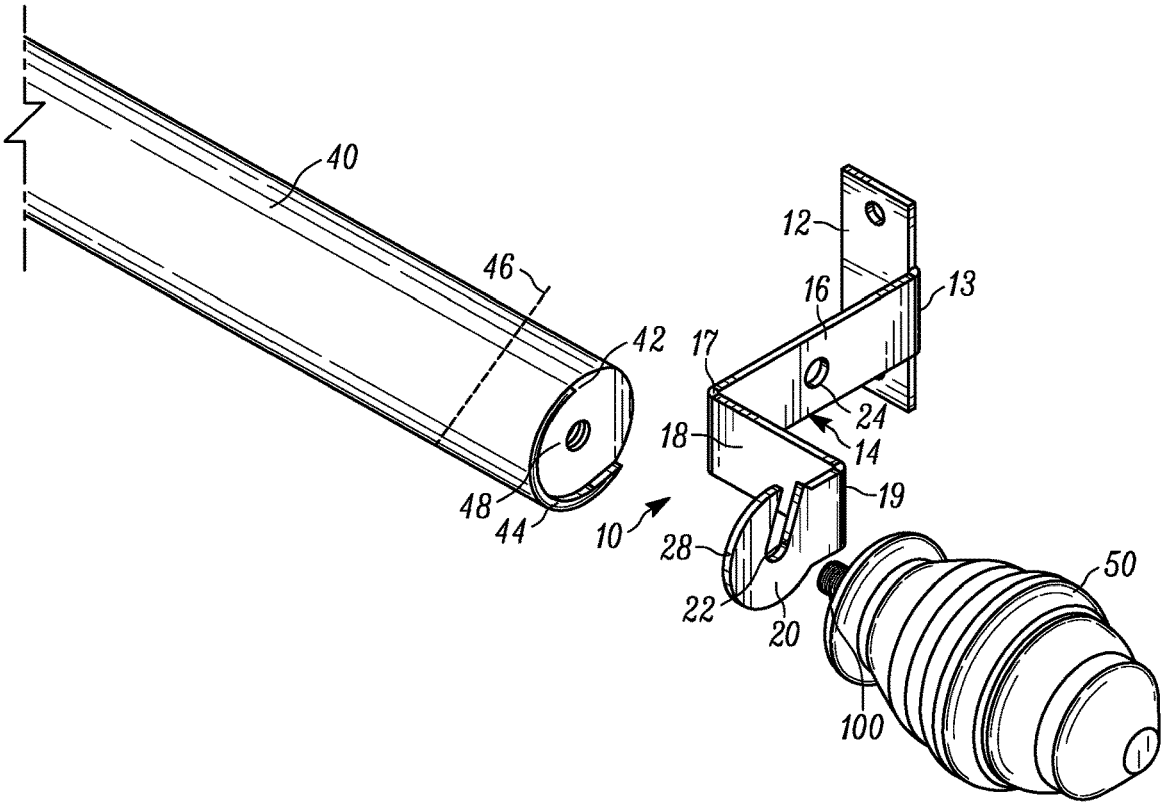
FIG. 10 is an exploded view of a rod assembly in which a recessed rod end is used.
Figure 12:
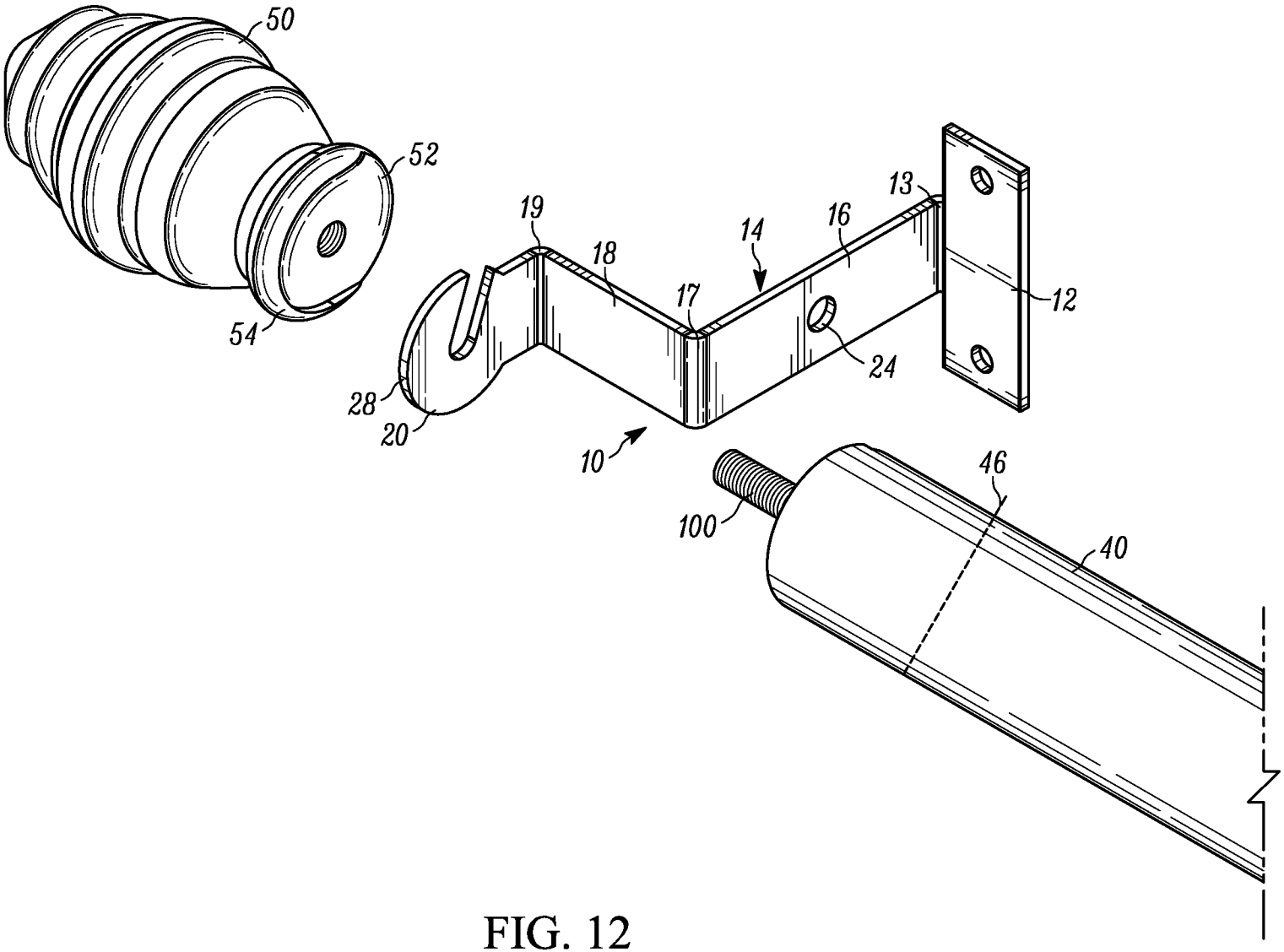
FIG. 12 is an exploded view of rod assembly in which a recessed finial is used.
Figure 13:
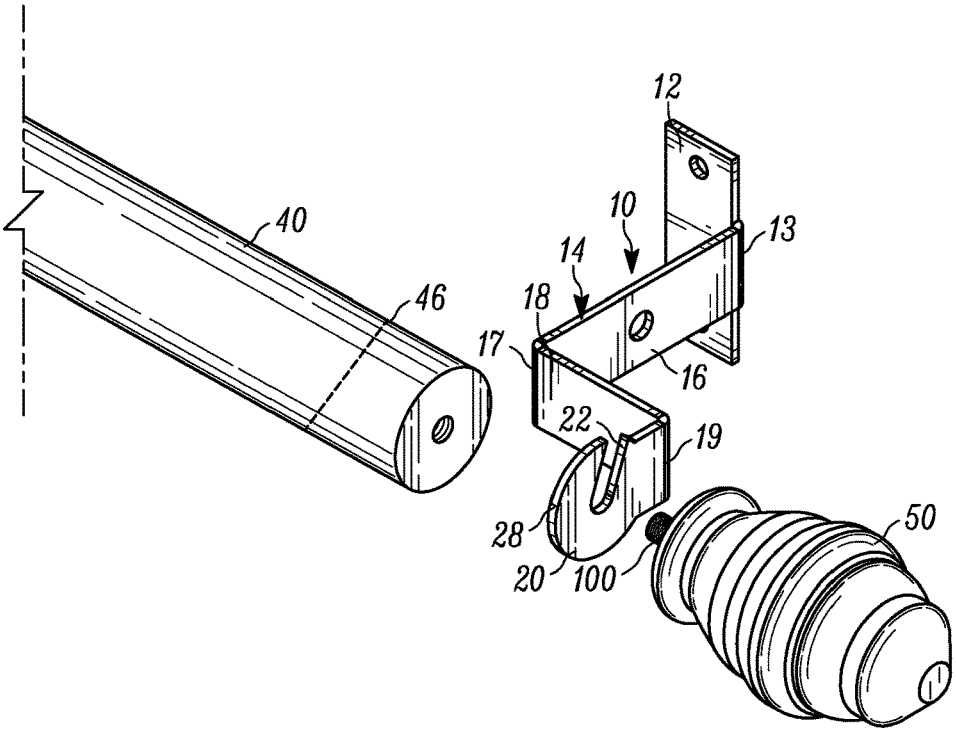
FIG. 13 is an exploded view of an alternate rod assembly where the first rod-attachment portion is visible when assembled.

The first rod-attachment portion 20 may include a rounded terminal end in which an opening 22 is formed. The opening 22 may be, for example, an aperture, or the opening 22 may be, for example, a partial opening that has been cut out or voided from the first rod-attachment portion 20. The opening 22 may be configured to accept a fastener 100 that attaches the rod 40 to the finial 50, as illustrated in FIGS. 10, 12, and 13. The first rod-attachment portion 20 may have a uniform width, or the outer profile of the terminal end of the rod-attachment portion 20 may have a width that is larger than the width of the end of the first rod attachment portion that attaches to the distal segment 18 of the arm portion 14. As shown in in FIG. 15, the outer profile of the terminal end of the rod-attachment portion 20 may be larger, smaller, or equal in size to the diameter of the rod 40, depending on the configuration of the rod 40 and the finial 50 to be used.

Figure 4:
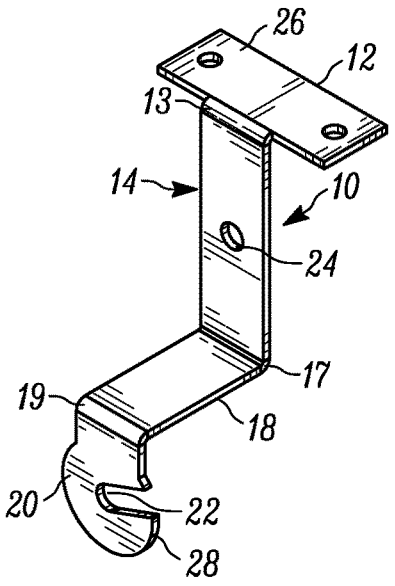
FIG. 4 is a perspective view of a bracket.
Figure 5:
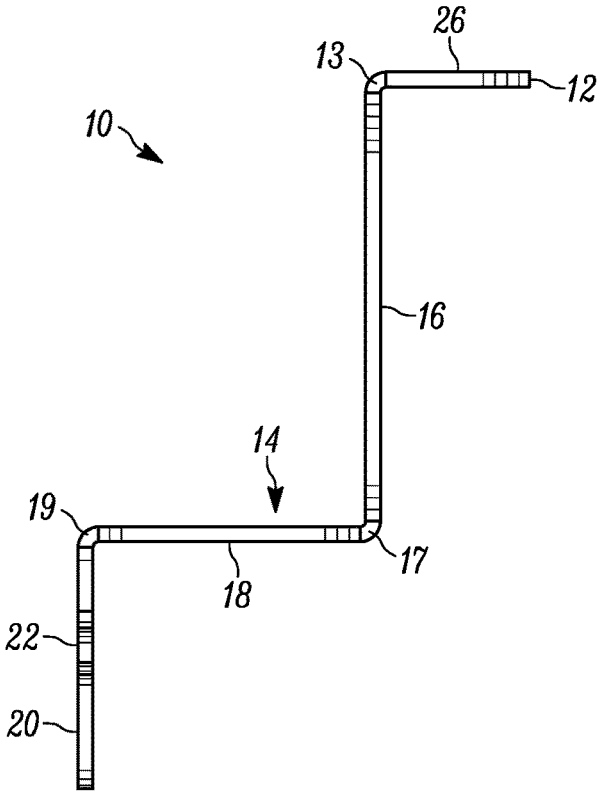
FIG. 5 is a top plan view of the bracket in FIG. 4.
Figure 6:
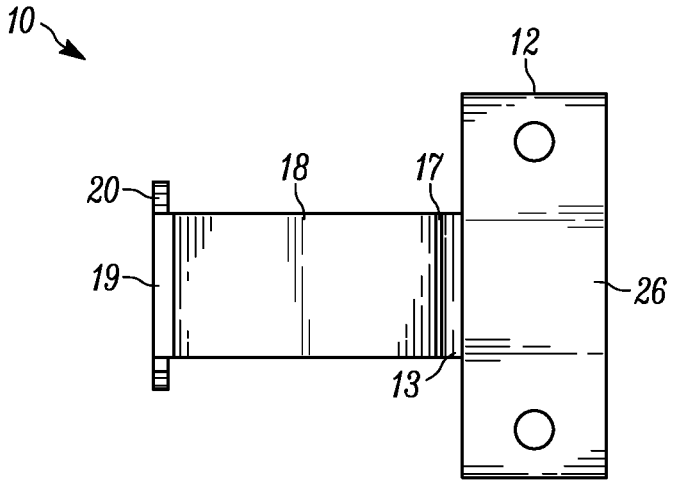
FIG. 6 is a rear view of the bracket in FIG. 4.
Figure 7:
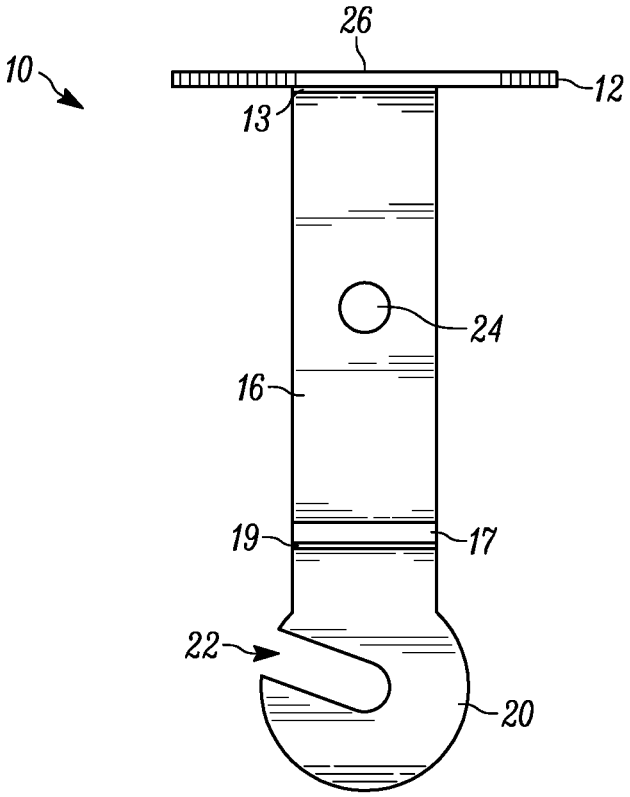
FIG. 7 is a side view of the bracket in FIG. 4
Figure 16:
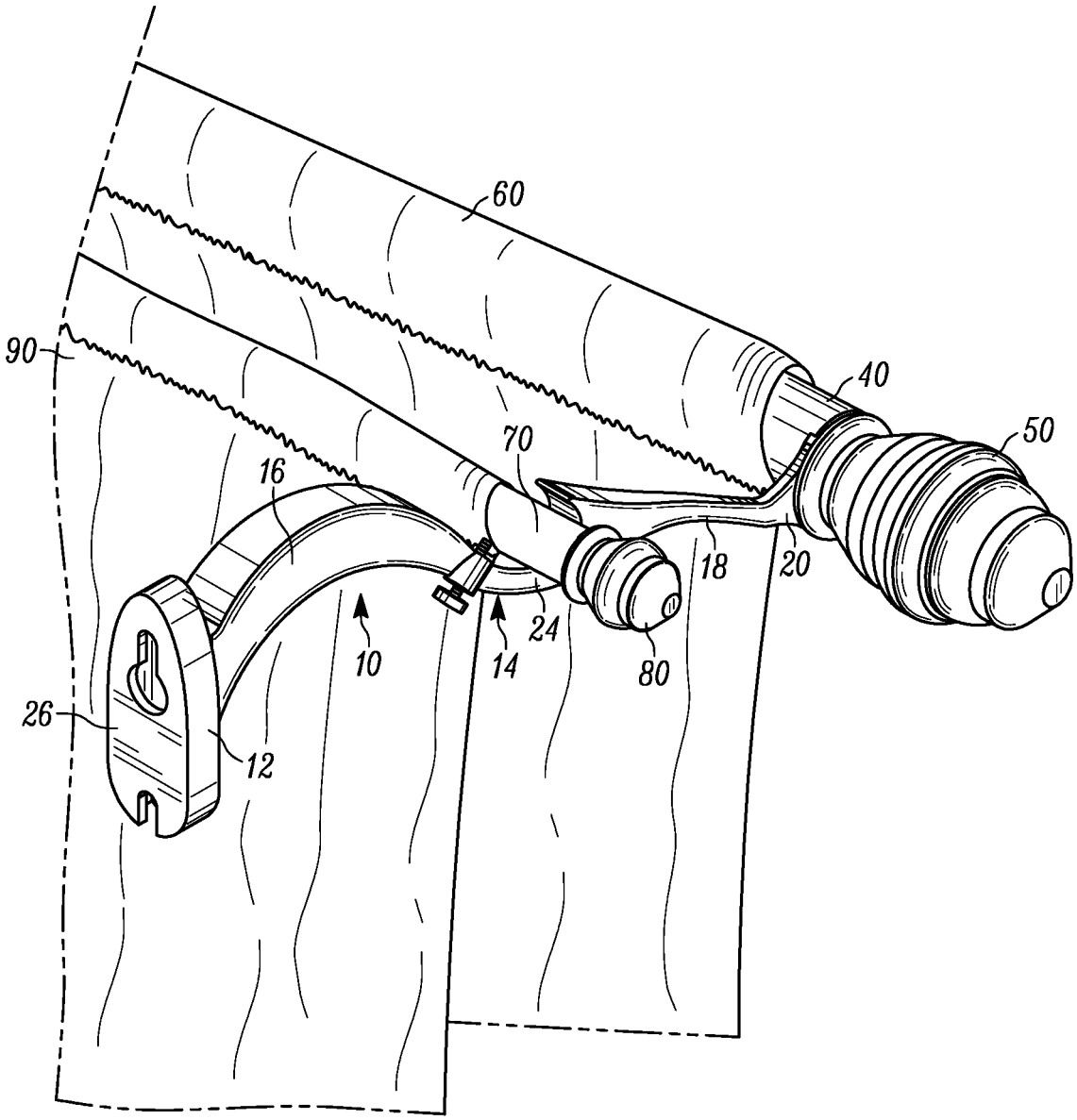
FIG. 16 is a perspective view of a double rod assembly using a curved bracket.
Figure 17:
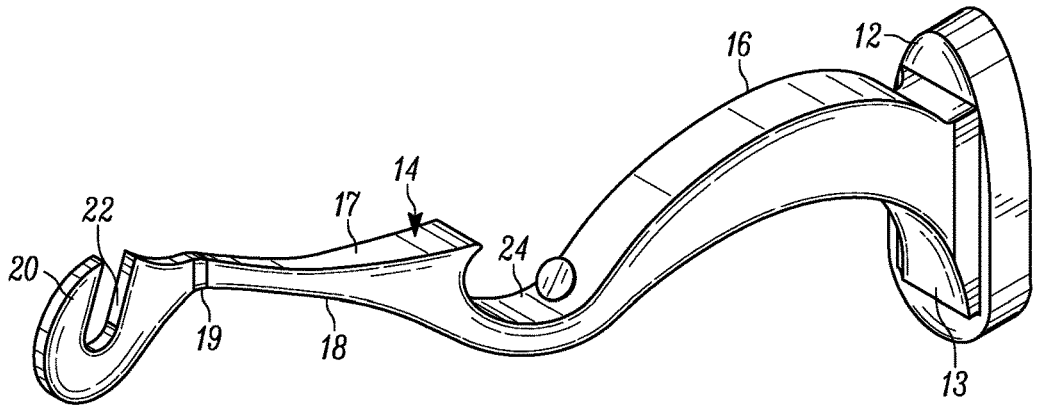
FIG. 17 is a perspective view of the curved bracket in FIG. 16.
Figure 18:
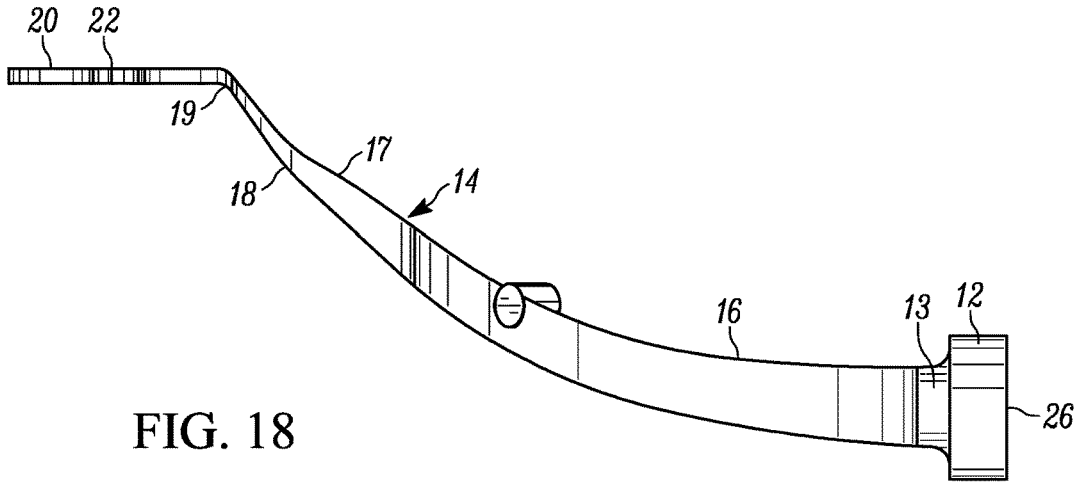
FIG. 18 is a top plan view of the curved bracket in FIG. 16 in a left-handed configuration.
Figure 19:
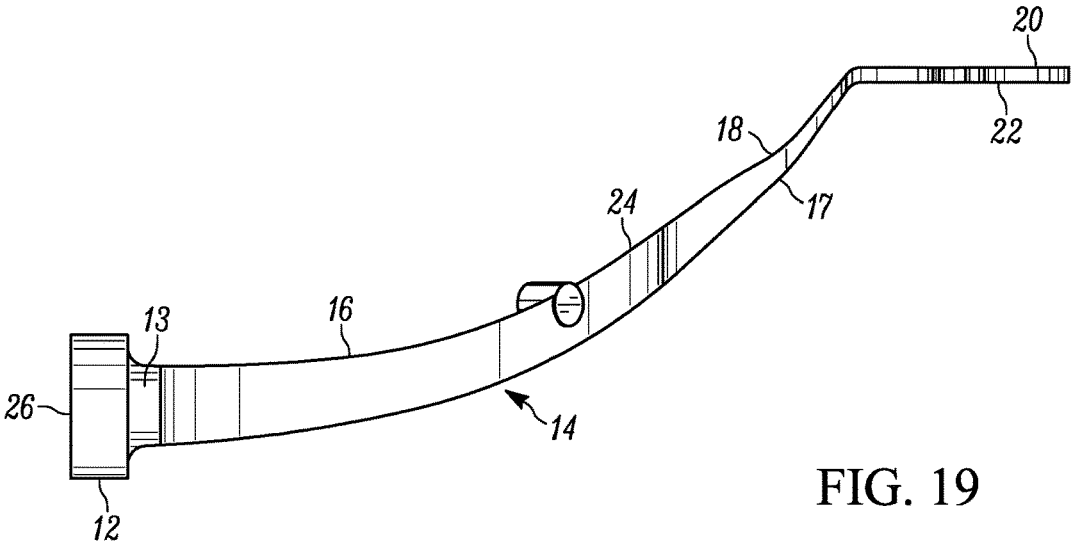
FIG. 19 is a top plan view of the curved bracket in FIG. 16 in a right-handed configuration.
Figure 20:
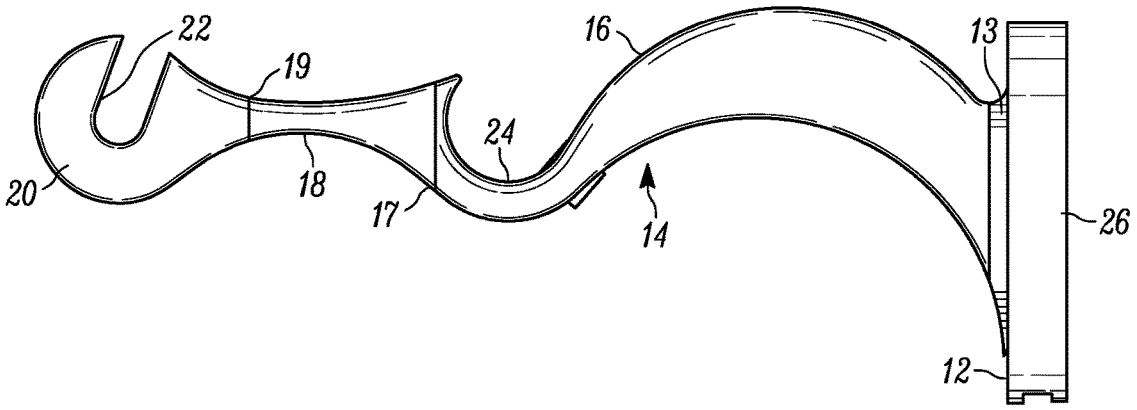
FIG. 20 is a side view of the curved bracket in FIG. 16.

In some embodiments, as illustrated in FIG. 4, the bracket 10 may also include a second rod-attachment portion 24, which may be disposed in the proximal segment 16 of the arm 14. The second rod-attachment portion 24 includes an opening such as, for example, an aperture to accept a fastener that attaches a second rod 70 to a second finial 80. The opening may also be a partial opening configured such that second rod 70 may be lowered into the opening, as illustrated in FIG. 16.

In a preferred embodiment of the bracket 10, the mounting portion 12 may have a vertically-extending longitudinal axis and may be configured to be mounted to a wall using screws that may be aligned vertically. The proximal segment 16 of arm portion 14 may extend horizontally in a vertical plane from the mounting portion 12 in a direction that is substantially perpendicular to the longitudinal axis the mounting portion 12. The interface 13 between the mounting portion 12 and the proximal segment 16 may extend vertically along an axis that is substantially parallel to the longitudinal axis of the mounting portion 12. The length of the proximal segment 16 may be, for example, between two and three inches.

The distal segment 18 of the of arm portion 14 may extend from the proximal segment 16 in a direction that is substantially parallel to the back surface 26 of the mounting portion 12 and substantially perpendicular to the proximal segment 16, such that the distal segment 18 does not cross in front of the mounting portion 12. The interface 17 between the proximal segment 16 and distal segment 18 may extend vertically along an axis that is substantially parallel to the longitudinal axis of mounting portion 12. The length of the distal segment 18 may be, for example, between one and two inches.

The first rod-attachment portion 20 may extend from the distal segment 18 in a direction that is substantially parallel to the proximal segment 16. The interface 19 between the distal segment 18 and the first rod-attachment portion 20 may extend vertically along an axis that is substantially parallel to the longitudinal axis of the mounting portion 12. The length of the first rod-attachment portion from its opening 22 to the interface 19 where the first rod-attachment portion 20 meets distal segment 18 may be less than an inch. The vertical axis of each of interface 13, interface 17, and interface 19 may be substantially parallel to one another. The vertically-extending interfaces increase the strength of the bracket so to prevent failure through bending of the bracket at the interfaces when downward force is applied to the rod attachment portion. By contrast, conventional "L-shaped" brackets, where an arm portion extends horizontally over the top of a vertical mounting portion (where the interfaces are horizontal), are susceptible to bending at the horizontally-aligned wall bend interface when downward force is applied to the rod attachment portion.

FIGS. 8 and 9 illustrate an embodiment of the bracket 10 where the arm portion 14 has a linear configuration, but may otherwise be similar to the preferred embodiment described above. In this linear configuration, the arm portion 14 may bridge the mounting portion 12 and the first rod-attachment portion 20 such that the proximal segment 16 may form an obtuse angle 30 with the mounting portion 12, and the distal segment 18 may form an obtuse angle 32 with the first rod-attachment portion 20. The obtuse angle 30 at which the arm portion 14 extends from the mounting portion 12 may be, for example, between about 110° to about 130°, and the obtuse angle 32 at which the first rod-attachment portion extends from the distal segment 18 may be, for example, between about 135° to about 155°. The length of the arm portion 14 may be, for example, between two and three inches. In this configuration, the proximal segment 16 and the distal segment 18 may be coplanar. The interface 13 between the mounting portion 12 and the proximal segment 16, and the interface 19 between the distal segment 18 and the first rod-attachment portion 20, may extend vertically along axes that are substantially parallel to the longitudinal axis of the mounting portion 12.

Figure 21:
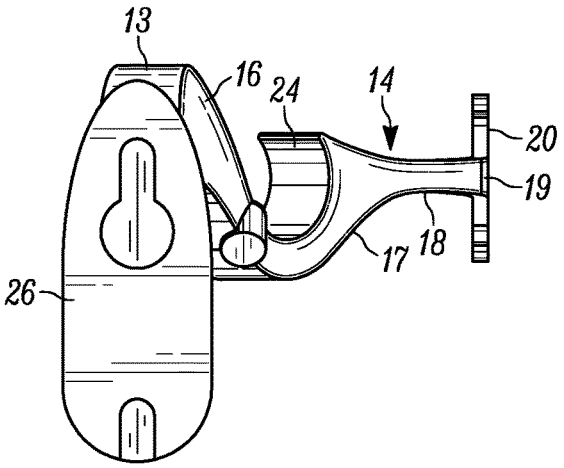
FIG. 21 is a rear view of the curved bracket in FIG. 16.
Figure 22:
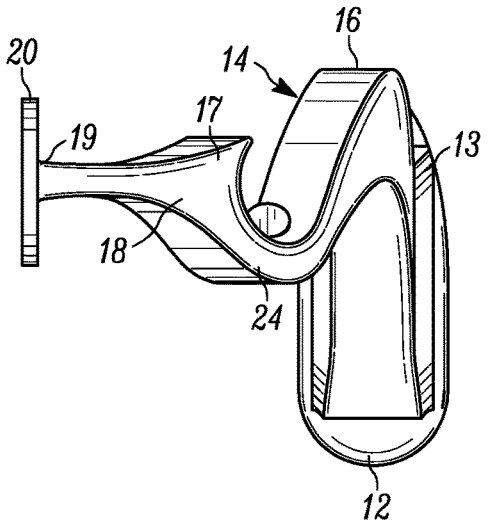
FIG. 22 is a front view of the curved bracket in FIG. 16.

FIGS. 16-22 illustrate a bracket 10 that has a curved shape as an alternative to the angular shapes depicted in FIGS. 1-14. In this configuration, the mounting portion 12, first rod-attachment portion 20, and second rod-attachment 24 portion may have the same configuration, components, and attributes as described above for the angular brackets. As shown in FIGS. 16 and 21, the mounting portion 12 may have a vertically-extending longitudinal axis and may be configured to be mounted to a wall using one or more screws and/or anchors that may be aligned vertically.

In the curved embodiment of bracket 10 illustrated in FIGS. 16-22, the proximal segment 16 may initially extend horizontally from the mounting portion 12 via an interface 13 in a direction that is substantially perpendicular to the back surface 26 of the vertically-extending mounting portion 12. The proximal segment 16 may then gradually curve away from the center axis of the mounting portion 12 such that the distal segment 18, disposed at the end of the proximal segment 16 via interface 17, does not cross in front of the mounting portion 12. The distal segment 18 may curve in the same direction as the proximal segment 16. The first rod-attachment portion 20, disposed at the terminal end of the distal segment 18 via interface 19, may extend horizontally in the same direction that the proximal segment 16 initially extends. In this configuration, the interface 13, interface 17, and interface 19 may each extend vertically along an axis that is substantially parallel to the longitudinal axis of the mounting portion 12.

In the curved embodiment, bracket 10 may include a second rod-attachment portion 24 disposed in the proximal segment 16 of the arm 14. The second rod-attachment portion 24 may comprise a partial opening configured such that second rod 70 may be lowered into the opening. As shown in FIG. 16, the second rod 70 may be secured to the second rod-attachment portion 24 in its resting position by a fastener such as, for example, a set screw.

Specific embodiments of the bracket and system described herein are presented below in more detail. In each embodiment, the bracket and system are configured such that the rod may extend in a gap that is created between the longitudinal axis of the proximal segment and the longitudinal axis of the first rod-attachment portion such that the bracket does not interrupt movement of the drapery along the length of the rod and allows maximum drawback of the drapery. In embodiments described below, the bracket may have an angular shape, as illustrated in FIGS. 1-14, or a curved shape, as illustrated in FIGS. 16-22.

Figure 11:
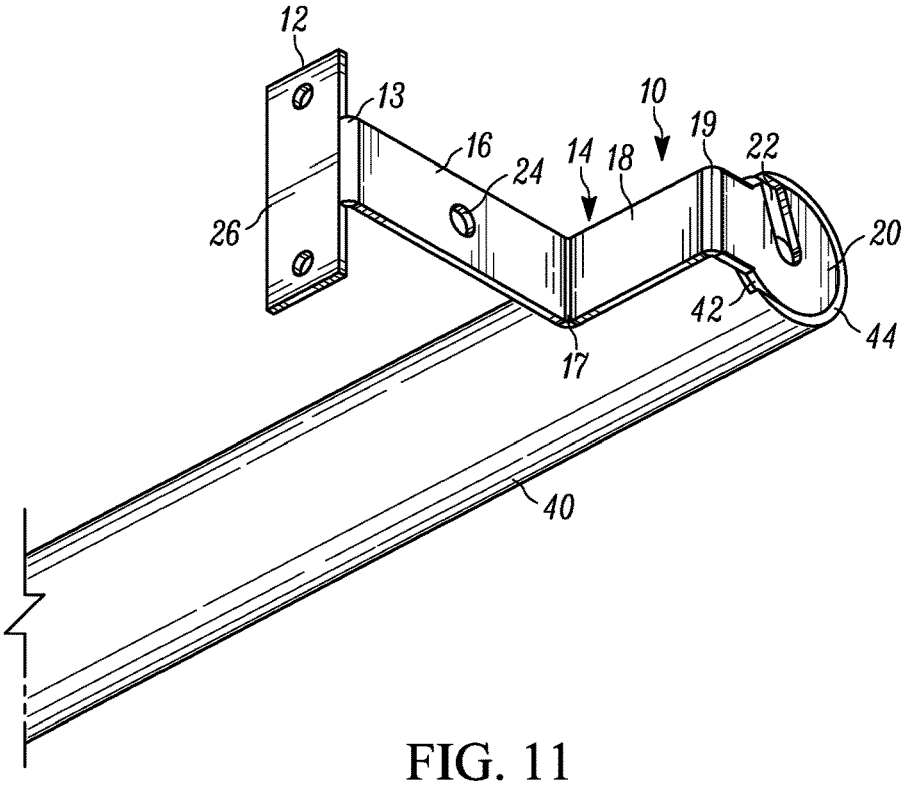
FIG. 11 is a perspective view of the assembled rod and bracket in FIG. 10

In an embodiment illustrated in FIGS. 10 and 11, the first rod-attachment portion 20 may have a rounded terminal end having an outer profile that may be smaller in size than the diameter 46 of the rod 40. In this configuration, the rod 40 includes a recess 42 that has been formed in the end of the rod 40 for accepting the first rod-attachment portion 20 of the bracket 10. The recess 42 may be shaped such that at least a portion of the terminal end of the first rod-attachment portion 20 is concealed when the finial 50, first rod-attachment portion 20, and end portion of the rod 40 are in an assembled configuration. The recess 42 may also have the same shape as the terminal end of first rod-attachment portion 20. An arcuate notch 48 formed in the terminal end of the rod 40 allows the first rod-attachment portion 20 to extend from the recess 42. The first rod-attachment portion 20 may be embedded in the recess 42 in the end portion of the rod 40 such that the edge 44 of the end portion of the rod 40 is able to contact the finial 50 and the edge 28 of the terminal end of the first rod-attachment portion 20 is not visible when the rod 40, the first rod-attachment portion 20, and finial 50 are assembled.

An alternate embodiment is illustrated in FIG. 12. In this configuration, the first rod-attachment portion 20 may have a rounded terminal end having an outer profile that may be smaller in size than the diameter 46 of the rod 40. In this configuration, the finial 50 includes a recess 52 that has been formed in the end of the finial 50 for accepting the first rod-attachment portion 20 of the bracket 10. The recess 52 may be shaped such that at least a portion of the terminal end of the first rod-attachment portion 20 is concealed when the finial 50, first rod-attachment portion 20, and end portion of the rod 40 are in an assembled configuration. The recess 52 may also have the same shape as the first rod-attachment portion 20. The finial 50 may include an arcuate notch 54, which allows the first rod-attachment portion 20 to extend from the recess 52. The first rod-attachment portion 20 may be embedded in the recess 52 in the end portion of the finial 50 such that the edge 44 of the end portion of the rod 40 is able to contact the finial 50 and the edge 28 of the terminal end of the first rod-attachment portion 20 is not visible when the rod 40, the first rod-attachment portion 20, and finial 50 are assembled.

Figure 14:
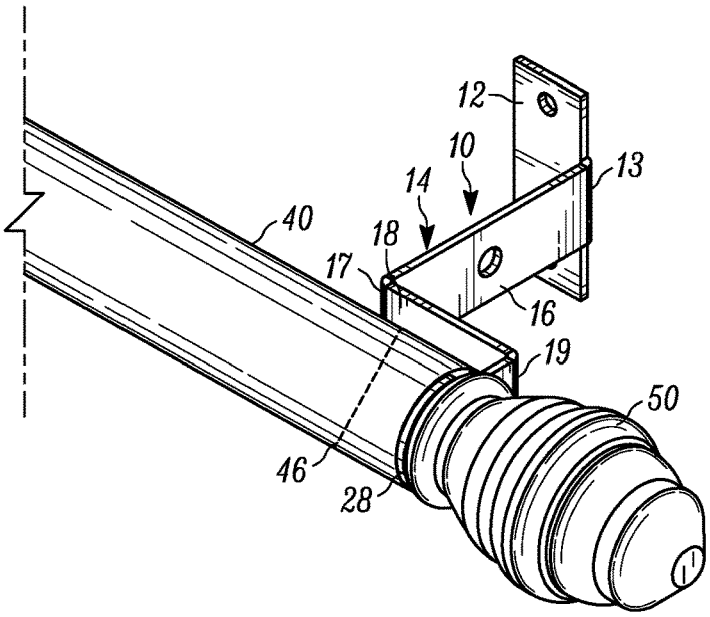
FIG. 14 is a perspective view of the alternate rod assembly in FIG. 13.
Figure 15A:
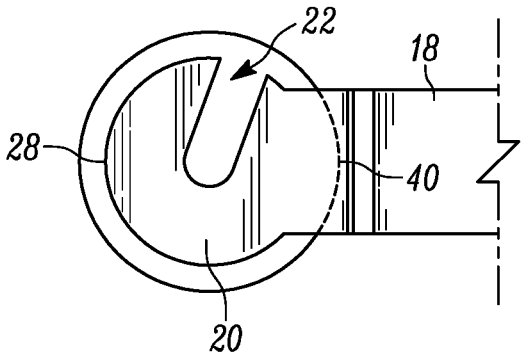
FIG. 15A illustrates the bracket and rod assembly where the outer profile of the rounded terminal end of the rod attachment portion is larger than the outer profile of the rod.
Figure 15B:
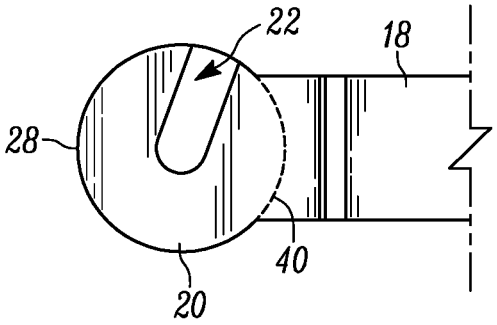
FIG. 15B illustrates the bracket and rod assembly where the outer profile of the rounded terminal end of the rod attachment portion is equal to the outer profile of the rod.
Figure 15C:
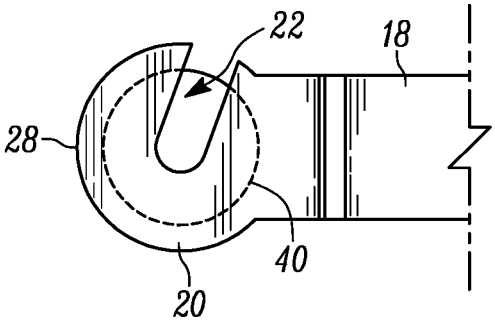
FIG. 15C illustrates the bracket and rod assembly where the outer profile of the rounded terminal end of the rod attachment portion is smaller than the outer profile of the rod.

In another embodiment illustrated in FIGS. 13 and 14, the first rod-attachment portion 20 is not embedded in the rod 40 or the finial 50, and instead acts as an interface between the rod 40 and finial 50 such that the rod 40 and finial 50 do not contact each other. In this configuration, the ends of the rod 40 and finial 50 that contact the first rod-attachment portion 20 may have a substantially flat surface. The first rod-attachment portion 20 of bracket 10 may have a rounded terminal end having an outer profile that may be equal to or larger in size than the outer diameter 46 of the rod 40 such that edge 28 of the terminal end of the first rod-attachment portion 20 may be visible when the rod 40, first rod-attachment portion 20, and finial 50 are assembled. The rounded terminal end may also be smaller in size than the outer diameter 46 of the rod 40. FIG. 15 illustrates various embodiments of the bracket and rod assembly where the outer profile of the rounded terminal end of the rod attachment portion may be larger, smaller, or equal to the outer profile of the rod.

Figure 23:
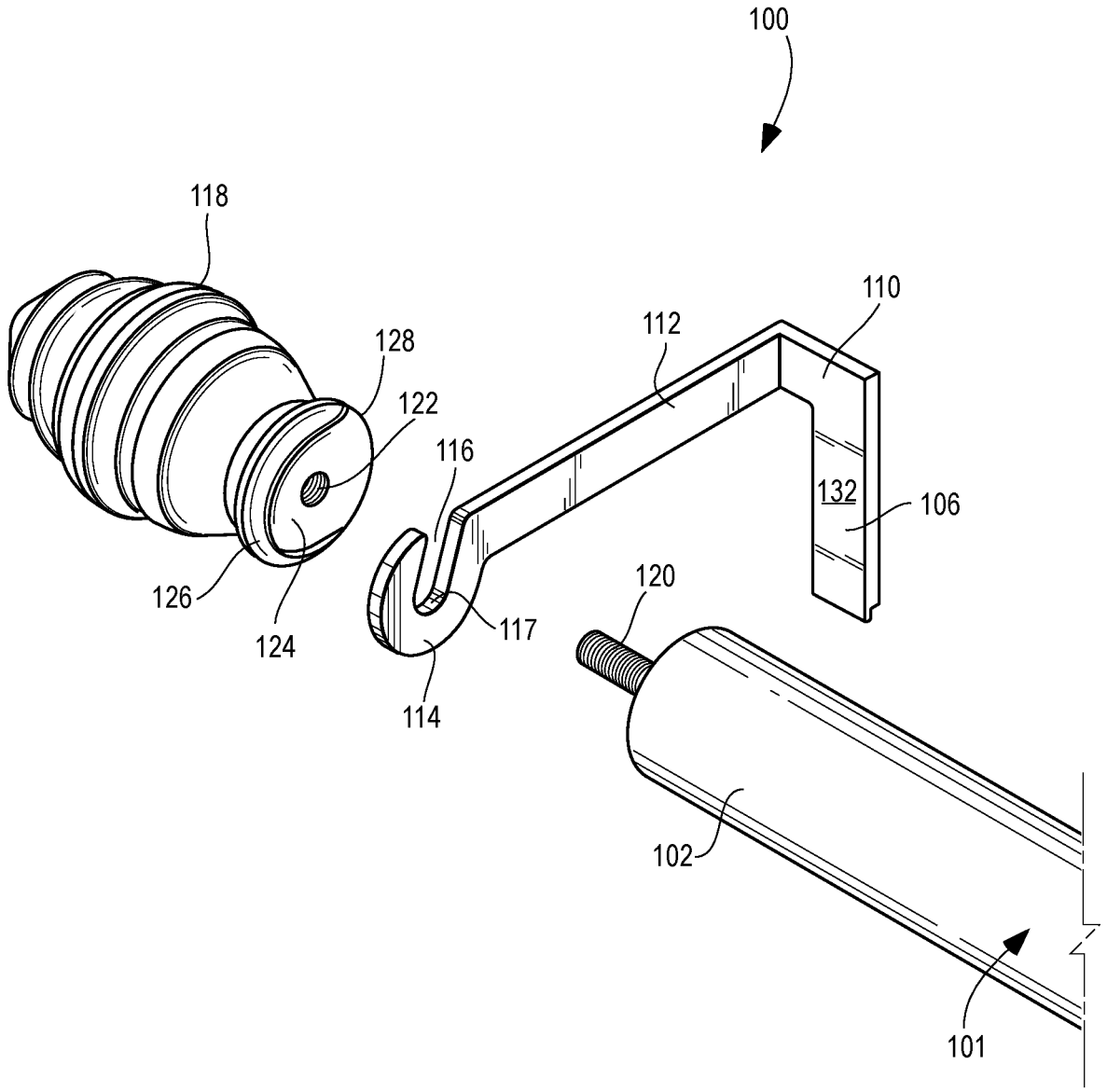
FIG. 23 is an exploded perspective view of a rod assembly with a left-handed version of an alternative bracket.
Figure 24:
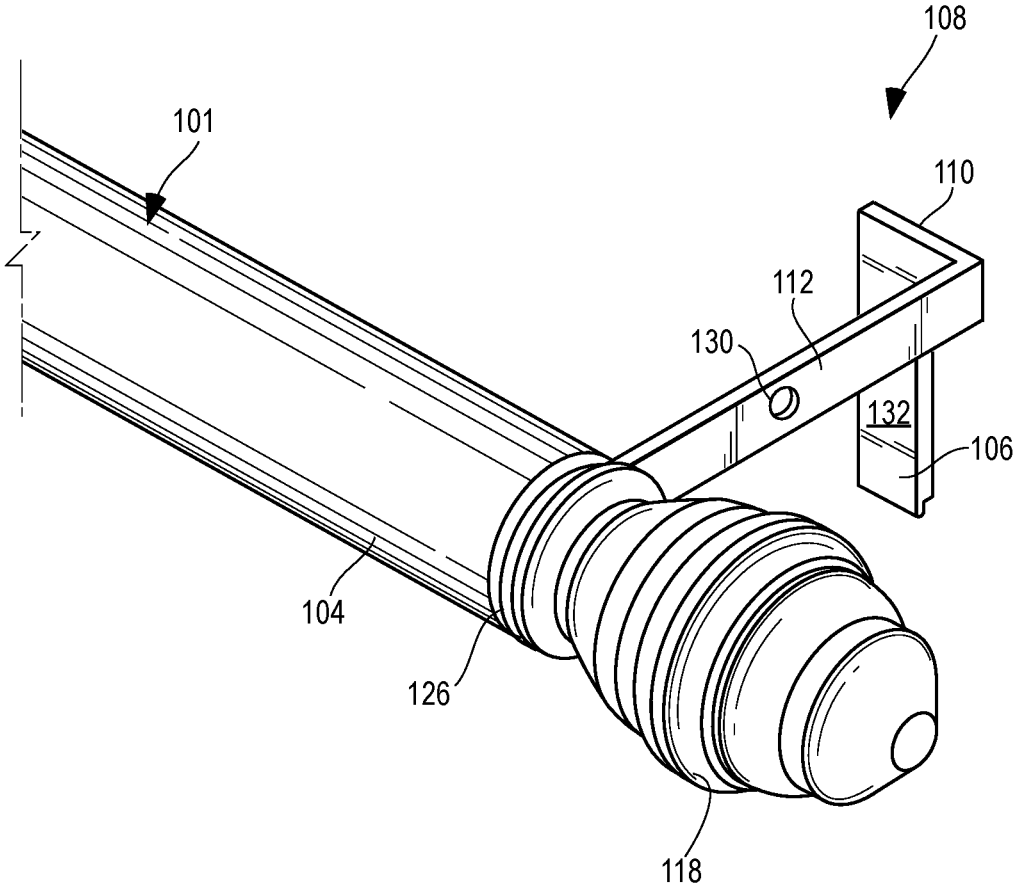
FIG. 24 is an assembled perspective view of the rod assembly of FIG. 23 with a right-handed version of the alternative bracket.
Figure 25:
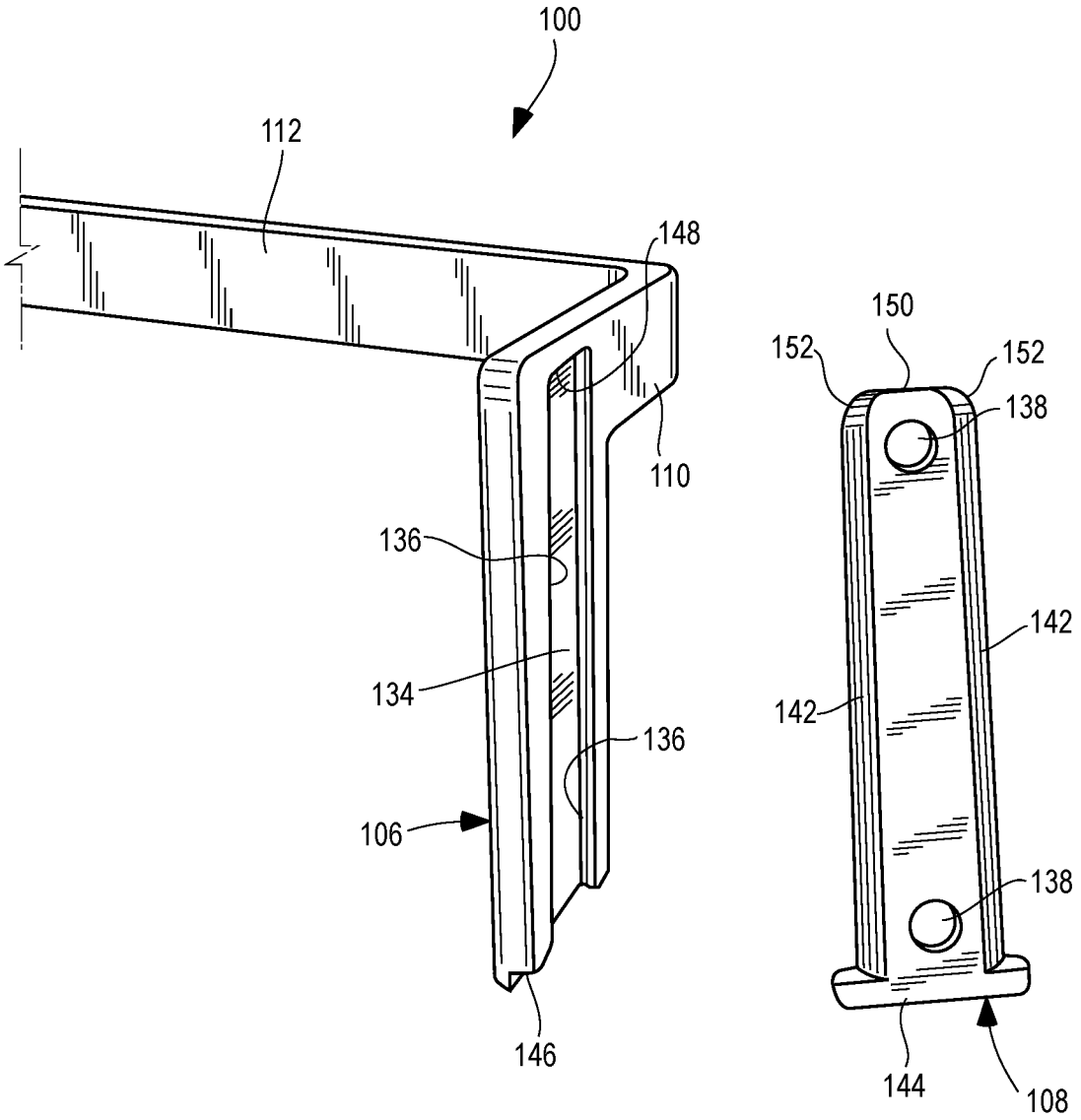
FIG. 25 is an exploded perspective view of the alternative bracket of the rod assembly of FIG. 23.

With reference to FIGS. 23-25, there is illustrated another bracket 100. A left-handed version of the bracket 100 is shown in FIG. 23, and a right-handed version of the bracket 100 is shown in FIG. 24. The brackets can be used to support a rod 101. More specifically, the left-handed version is used to support a left end 102 of the rod 101, and the right-handed version is used to support a right end 104 of the rod 101. The right- and left-handed versions of the brackets are mirror images of one another. So, the same reference numbers will be used for both.

The bracket 100 includes a mounting portion 106 for mounting the bracket 100 to a surface, such as a surface of a wall or ceiling. A mounting plate 108 (FIG. 25) cooperates with the mounting portion 106 to mount the bracket 100. The bracket 100 includes a lateral segment 110 that extends outboard of the mounting portion 106. The lateral segment 110 may extend in the same plane as the mounting portion 106. An outward segment 112 extends away from the mounting portion 106. The outward segment 112 may extend transversely to the lateral segment 110. For example, the outward segment 112 may extend perpendicularly to the lateral segment 110. The outward segment 112 terminates with an attachment portion 114. The attachment portion 114 includes an opening 116 for attaching to and supporting the left and right ends 102, 104 of the rod 101. The attachment portion 114 may be an enlarged portion relative to the outward segment 112. The attachment portion 114 may be disc-like in shape.

As with previous embodiments, the opening 116 may be upward facing. For example, the opening 116 could be angled at any angle above horizontal, such as angle back toward the mounting portion 106, angle vertically, or angle away from the mounting portion 106. The opening 116 could also flare outward from a bottom 117.

As with the embodiments above, the rod 101 can be used for hanging fabrics, such as drapery. The outboard position of the attachment portion 114 relative to the mounting portion 106 enables the hanging fabric to cover the mounting portion 114 of the bracket 100. The upward facing nature of the opening 116 of the mounting portion 114 of the left- and right-handed brackets 100 enable the rod 101 to be easily installed. More specifically, the ends 102,104 of the rod 101 may cooperate with a final 118. A threaded shaft 120 can be carried by either the finial 118 or the end 102,104 of the rod 101. The finial 118 and the end 102,104 of the rod 101 each include a threaded hole 122 that cooperates with the threaded shaft 120. The finial 118 can be attached to each end 102, 104 of the rod 101 leaving an exposed portion of the threaded shaft 120 at least the thickness of the attachment portion 114. The rod 101 then can be lowered toward the brackets 100 so that the threaded shaft 120 on each end 102, 104 of the rod 101 is received in the opening 116 of the attachment portions 114 of the left- and right-handed brackets 100. Next, the finial 118 and the rod 101 on each end are threaded together to clamp the attachment portion 114 between the finial 118 and the ends 102, 104 of the rod 101.

As described above, the finial 118 may have a recess 124 to receive and hide at least a portion of the attachment portion 114 when the finial 118 and the end portion 102, 104 are in the clamped state. More specifically, the recess 124 includes a front edge 126 that wraps around the attachment portion 114 and a rear notch 128 that allows the attachment portion 114 to extend from the finial 118. Alternatively, the end portions of the rod 40 may include the recess 42 to receive and hide at least a portion of the attachment portion 114 when the finials 50 and the end portions of the rod 40 are in the clamped state. A forward edge 44 about the recess 50 on the end portions of the rod 40 hides the attachment portion 114 and a notch 48 in the forward edge allows the attachment portion 114 to extend from the end portions of the rod 40.

The outward segment 112 may include a second opening 130 to support a second rod. The opening 130 could be a hole or it could be an upward facing opening like the opening 116 of the attachment portion 114.

The mounting portion 106 includes a flat front surface 132 and a rear side with a recess 134 extending longitudinally along the mounting portion 106. The recess 134 includes outer pockets 136 that extend along each side of the recess 134. The pockets 136 may have a triangular cross-section. The mounting plate 108 is sized to be received in the recess 134 with a relatively tight fit so that there is very little, if any, play between the mounting portion 106 and the mounting plate 108. The mounting plate 108 defines two holes 138 that each receive a fastener, such as screw or nail, to attach the mounting plate 108 to a surface. The holes 138 may include a recess (not shown) around them on an outboard side so heads of the fasteners are countersunk to sit flush with the outward facing side of the mounting plate 108 so that the fasteners do not interfere with insertion of the mounting plate 108 into the recess 134 of the mounting portion 106. The mounting plate 106 includes longitudinal edges 142 that have a triangular cross-section that complements that of the pockets 136 of the mounting portion 106 of the bracket 100. The mounting plate 108 includes a ledge 144 along one end. A terminal end 146 of the mounting portion 106 sits on the ledge 144 to support the bracket 100. An inner end 148 of the recess 134 may rest on the other end 150 of the mounting plate 108 to support the bracket 100. The end 150 may have rounded corners 152 to assist in sliding the recess 134 of the mounting portion 106 onto the mounting plate 108.

The bracket may be made of metal such as zinc.

It will be understood that various changes in the details, materials, and arrangements of parts and components which have been herein described and illustrated in order to explain the nature of the bracket and rod assembly system may be made by those skilled in the art within the principle and scope of the bracket and rod assembly system as expressed in the appended claims. Furthermore, while various features have been described with regard to particular embodiments, it will be appreciated that features described for one embodiment also may be incorporated with the other described embodiments.

What is claimed is:

1. A system for mounting a rod to a surface, the system comprising:

a rod having an end portion;

a finial;

an adjustment shaft interconnecting the finial to the end portion of the rod;

a bracket that comprises a mounting portion;

an arm portion extending outwardly from the mounting portion; and a first rod-attachment portion disposed at a terminal end of the arm portion, the first rod attachment portion defining an open-ended slot for receiving the shaft, the opened ended slot including a surface angling toward the mounting portion, wherein the shaft extends through the open-ended slot, the finial and the end portion having a first state along the shaft allowing release of the shaft upwardly from the open-ended slot and a second state where the finial and the end portion clamp the terminal end to prevent the shaft from being removed from the open-ended slot.

2. The system of claim 1, wherein the bracket comprises a single piece of material.

3. The system of claim 1, wherein the arm portion of the bracket includes a proximal segment and a distal segment, the proximal segment being attached to the mounting portion such that the arm portion initially extends outwardly from the mounting portion and the distal segment is substantially parallel to the mounting portion but does not overlap the mounting portion.

4. The system of claim 3, wherein the proximal segment of the arm portion forms an obtuse angle with the mounting portion, and the distal segment of the arm portion forms an obtuse angle with the first rod-attachment portion.

5. The system of claim 1, wherein the end portion of the rod includes a recess for accepting at least a portion of the first rod-attachment portion of the bracket such that at least a portion of the first rod-attachment portion is concealed when the finial and end portion of the rod are in the second state along the shaft.

6. The system of claim 5, wherein the rod has a notch at the recess and the first rod-attachment portion extends through the notch.

7. A system for mounting a rod to a surface, the system comprising:

a rod having an end portion;

a finial;

an adjustment shaft interconnecting the finial to the end portion of the rod;

a bracket that comprises a mounting portion;

an arm portion extending outwardly from the mounting portion;

a first rod-attachment portion disposed at a terminal end of the arm portion, the first rod attachment portion defining an upward facing opening for receiving the shaft;

wherein the shaft extends through the opening, the finial and the end portion having a first state along the shaft allowing release of the shaft upwardly from the opening and a second state where the finial and the end portion clamp the terminal end to prevent the shaft from being removed from the opening; and wherein the finial includes a recess for accepting at least a portion of the first rod-attachment portion of the bracket such that the finial is able to conceal at least a portion of the first rod-attachment portion when the finial and the end portion are in the second state along the shaft.

8. The system of claim 7, wherein the recess in the finial has an opening and the first rod-attachment portion extends through the opening.

9. The system of claim 1, wherein the first rod-attachment portion provides an interface between the finial and the end portion of the rod such that the finial does not contact the end portion of the rod when the finial, first rod-attachment portion, and end portion of the rod are in the second state along the shaft.

10. The system of claim 1, wherein the arm portion comprises a second rod-attachment portion disposed along the bracket, the second rod-attachment portion having an opening formed therein.

11. A system for mounting a rod to a surface, the system comprising:

a rod having an end portion;

a finial;

an adjustment shaft interconnecting the finial to the end portion of the rod;

a bracket that comprises a mounting portion;

an arm portion extending outwardly from the mounting portion;

a first rod-attachment portion disposed at a terminal end of the arm portion, the first rod attachment portion defining an upward facing opening for receiving the shaft;

wherein the shaft extends through the opening, the finial and the end portion having a first state along the shaft allowing release of the shaft upwardly from the opening and a second state where the finial and the end portion clamp the terminal end to prevent the shaft from being removed from the opening; and wherein the mounting portion is disposed on only one side of the arm portion, the rod is capable of suspending a swatch material, and the bracket does not restrict movement of the swatch material relative to the rod when the rod, bracket, and finial are in an assembled configuration until the swatch material overlaps the mounting portion.

12. The system of claim 1, wherein the shaft includes threading and either the finial or the first end portion includes cooperating threading to enable movement between the first state and the second state.

* * * * *